US012179255B2

(12) United States Patent
Xia et al.

(10) Patent No.: US 12,179,255 B2
(45) Date of Patent: Dec. 31, 2024

(54) ROLL SPINNING FORMING DEVICE AND METHOD FOR TOOTHED PART

(71) Applicant: SOUTH CHINA UNIVERSITY OF TECHNOLOGY, Guangzhou (CN)

(72) Inventors: Qinxiang Xia, Guangzhou (CN); Xiuquan Cheng, Guangzhou (CN); Gangfeng Xiao, Guangzhou (CN); Xuyang Bian, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 534 days.

(21) Appl. No.: 17/600,121

(22) PCT Filed: Oct. 31, 2019

(86) PCT No.: PCT/CN2019/114526
§ 371 (c)(1),
(2) Date: Sep. 30, 2021

(87) PCT Pub. No.: WO2020/199574
PCT Pub. Date: Oct. 8, 2020

(65) Prior Publication Data

US 2022/0168799 A1 Jun. 2, 2022

(30) Foreign Application Priority Data

Apr. 4, 2019 (CN) ..... 201910272358.2

(51) Int. Cl.
*B21H 5/02* (2006.01)
*B21D 53/28* (2006.01)

(52) U.S. Cl.
CPC ..... *B21H 5/02* (2013.01); *B21D 53/28* (2013.01)

(58) Field of Classification Search
CPC . B21H 5/02; B21H 5/00; B21D 53/28; B21D 22/16; Y10T 29/49471
(Continued)

(56) References Cited

U.S. PATENT DOCUMENTS 2,464,658 A 3/1949 Stivin
3,455,139 A * 7/1969 Joslin ..... B23F 19/00 72/451
(Continued)

FOREIGN PATENT DOCUMENTS

CN 103191964 7/2013
CN 104942151 9/2015
(Continued)

OTHER PUBLICATIONS

JH 0237929 Masami, et alia (Feb. 7, 1990) (MT) (Year: 1990).*
(Continued)

*Primary Examiner* — Adam J Eiseman
*Assistant Examiner* — Fred C Hammers
(74) *Attorney, Agent, or Firm* — JCIPRNET

(57) ABSTRACT

Disclosed is a roll spinning forming device for a toothed part. The device is mounted on a machine tool body. A blank, a mandrel and a driving synchromesh gear are mounted on a machine tool spindle. A driven synchromesh gear and a roller are arranged in parallel on the spindle. The driven synchromesh gear and the roller are connected by a telescopic constant speed universal joint and rotate at a same angular speed. The driven synchromesh gear is driven by a spring mechanism in the radial direction, and the roller is driven by a servo motor assembly in the radial direction. Further disclosed is a roll spinning forming method for a toothed part, the rotating speed of the blank is maintained to
(Continued)

be matched with the rotating speed of the roller according to a gear ratio during the movement of the roller toward the blank.

10 Claims, 2 Drawing Sheets

(58) Field of Classification Search
USPC ..... 72/68, 102–109
See application file for complete search history.

(56) References Cited

U.S. PATENT DOCUMENTS 3,717,017 A * 2/1973 Vukovich ..... B21H 5/02 72/126
4,116,032 A * 9/1978 Krapfenbauer ..... B21H 5/02 72/110
4,596,127 A * 6/1986 Hill ..... B21D 53/28 72/469
4,756,179 A * 7/1988 Anderson ..... B21H 5/02 72/88
2003/0167813 A1* 9/2003 Shinbutsu ..... B21H 5/005 72/104

FOREIGN PATENT DOCUMENTS

| | | |
|---|---|---|
| CN | 108160793 | 6/2018 |
| CN | 110076230 | 8/2019 |
| JP | H10193023 | 7/1998 |

OTHER PUBLICATIONS

"International Search Report (Form PCT/ISA/210) of PCT/CN2019/114526", mailed on Feb. 6, 2020, with English translation thereof, pp. 1-4.

* cited by examiner

ROLL SPINNING FORMING DEVICE AND METHOD FOR TOOTHED PART

CROSS-REFERENCE TO RELATED APPLICATION

This application is a 371 of international application of PCT application serial no. PCT/CN2019/114526, filed on Oct. 31, 2019 which claims the priority benefit of China application no. 201910272358.2, filed on Apr. 4, 2019. The entirety of each of the above mentioned patent applications is hereby incorporated by reference herein and made a part of this specification.

BACKGROUND

Technical Field

The present invention relates to machining of toothed parts, belongs to the technical field of plastic forming, and particularly relates to a roll spinning forming device and method for a toothed part.

Description of Related Art

Generally, the machining of toothed parts is divided into cutting and roll spinning forming. Due to low production efficiency of cutting and low part strength caused by that a fiber tissue is cut off by a blank, the cutting is often replaced by the roll spinning forming. However, the conventional toothed part roll spinning forming adopts active rotation of the roller, but the rotation of the blank is free. Since the axis of the roller is close to the axis of the blank continuously in the forming process, the pitch is changing constantly. Therefore, the special toothed profile of the roller and the roll spinning process parameters must be designed in combination with the characteristic in the roll spinning process, so that the precision of the formed toothed part can be improved. In this way, the tooth shape design of the roller is complicated, the biting problem of the roller on the blank exists, and the forming quality of the part is relatively poor.

The industry has been looking for a method for controlling rotation of a blank in the toothed part roll spinning forming process to ensure accurate tooth division, but due to the complex structure of the device, a feasible method and forming device have not been put forward.

SUMMARY

In order to overcome the shortage in the prior art, an objective of the present invention is to provide a roll spinning forming method and device for a toothed part, so that a blank and a roller rotate according to a constant rotating speed ratio, and accurate tooth division of the blank is realized. Both external gear parts and internal gear parts may be formed.

To achieve the above objective, the present invention provides the following technical solution.

The present invention provides a roll spinning forming device for a toothed part. The device is mounted on a machine tool body and includes a spindle, a mandrel, a driving synchromesh gear, a driven synchromesh gear, a driven synchromesh gear support, a roller, a roller support, a telescopic constant speed universal joint assembly, a spring mechanism and a servo motor assembly. The mandrel is mounted on an upper end surface of the spindle, and the driving synchromesh gear is mounted on the spindle and is located below the mandrel. Both the driven synchromesh gear and the roller support are L-shaped supports. The driven synchromesh gear support includes a first vertical plate and a first bottom plate, the first vertical plate and the first bottom plate are integrally formed. The roller support includes a second vertical plate and a second bottom plate, the second vertical plate and the second bottom plate are integrally formed. The first bottom plate and the second bottom late are arranged relatively in parallel, the first vertical plate and the second vertical plate are arranged in parallel. An inner side wall of the first vertical plate is contactable with an outer side wall of the second vertical plate. The driven synchromesh gear is mounted on the first bottom plate through a bearing, the roller is mounted on the second bottom plate through a bearing, and the driven synchromesh gear and the roller are arranged in parallel. The telescopic constant speed universal joint assembly is mounted between the roller and the driven synchromesh gear, thereby ensuring that the driven synchromesh gear and the roller rotate at the same angular speed and are capable of moving relatively in a radial direction. One end of the spring mechanism is connected to an outer side wall of the first vertical plate and the other end of the spring mechanism is connected to the machine tool body, and the spring mechanism pushes the driven synchromesh gear support to move towards the spindle. One end of the servo motor assembly is connected to the outer side wall of the second vertical plate through a bearing assembly and the other end of the servo motor assembly is connected to the machine tool body, and the servo motor assembly drives the roller support to move back and forth in the radial direction and drives the driven synchromesh gear support to move away from the spindle.

Preferably, a flow limiting block is arranged on the upper end surface of the spindle, and a diameter of the flow limiting block is greater than an outer diameter of the toothed part.

Preferably, the device further includes a pressing block pressing the blank used by the spinning formed toothed part on the mandrel.

Preferably, the device further includes a pressing block pressing the blank used by the spinning formed toothed part on the flow limiting block.

Preferably, a diameter of the pressing block is as same as the diameter of the flow limiting block.

Preferably, an outer side surface of the mandrel is provided with a tooth shape matched with the toothed part.

Preferably, an outer side surface of the roller is provided with the tooth shape matched with the toothed part.

The present invention further provides the roll spinning forming method for the toothed part using the aforementioned device. The method includes the following steps.

1) Mounting and pressing the blank used by the spinning formed toothed part.

2) Starting the spindle.

3) Using the servo motor assembly to push the roller support and drive the roller to move towards the spindle, and simultaneously using the spring mechanism to push the driven synchromesh gear support and drive the driven synchromesh gear to move towards the spindle.

4) When the driven synchromesh gear and the driving synchromesh gear are in contact with each other and gradually achieve complete engagement and synchronous rotation, enabling the driven synchromesh gear and the driven synchromesh gear support to stop moving, making the roller in contact with an outer surface of the blank, and maintaining the angular speed same as the angular speed of the driven synchromesh gear under the driving of the telescopic constant speed universal joint assembly.

5) Continuously pushing the roller by the servo motor assembly to move towards the spindle, providing a thrust by the spring mechanism to enable the driven synchromesh gear to be completely engaged with the driving synchromesh gear, enabling the roller to maintain a constant speed ratio with the blank under an action of the driven synchromesh gear and the driving synchromesh gear which are completely engaged with each other, and pressing the roller into the blank until forming a required tooth shape on the outer surface of the blank.

6) In a case that the driven synchromesh gear and the driving synchromesh gear are maintained to be completely engaged with each other, driving the roller and the roller support by the servo motor assembly to move away from the spindle until the roller is completely disengaged from the formed toothed shape.

7) Using the servo motor assembly to continuously drive the roller support to move away from the spindle, and drive the driven synchromesh gear support to move away from the spindle until the driven synchromesh gear is completely disengaged from the driving synchromesh gear, and moving the driven synchromesh gear to a safe position.

8) Stopping the spindle and disassembling the formed toothed part.

Preferably, under the condition that the driven synchromesh gear is completely engaged with the driving synchromesh gear, the roller is mounted and is accurately aligned with a phase angle of the mandrel.

Preferably, the rotation direction of the spindle in the step 5) is alternately forward and reverse.

Compared with existing roll spinning forming method and device for the toothed part, the present invention has the following advantages and beneficial effects.

(1) The tooth profile shape design of the roller is greatly simplified.

(2) The blank biting problem in the initial stage of roll spinning forming is avoided, the constant rotating speed ratio between the blank and the roller is ensured, and the quality of products is improved.

(3) Gear parts with large modulus may be formed.

DESCRIPTION OF THE EMBODIMENTS

The present invention will be further described below in conjunction with the accompanying drawings and embodiments. However, the claimed protection scope of the present invention is not limited to the scope expressed by the embodiments.

Embodiment 1

Figure 1:
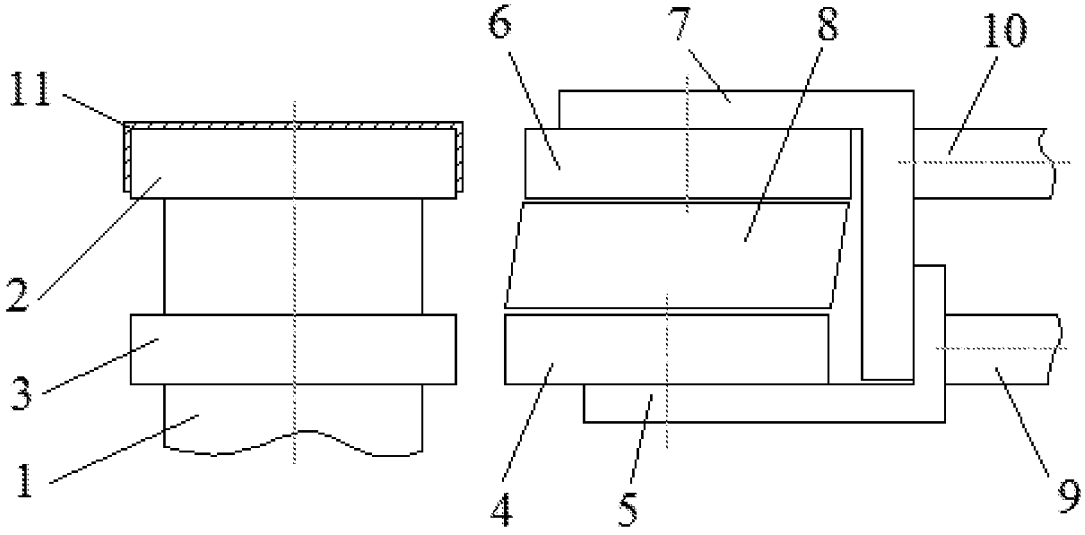
FIG. 1 is a structural schematic diagram of a roll spinning forming device for a cup-shaped external gear piece according to an embodiment 1.

This embodiment provides a roll spinning forming device for a cup-shaped external gear piece. FIG. 1 is a structural schematic diagram of a roll spinning forming device for a cup-shaped external gear piece according to an embodiment 1. The device is mounted on a machine tool body and includes a spindle 1, a mandrel 2, a driving synchromesh gear 3, a driven synchromesh gear 4, a driven synchromesh gear support 5, a roller 6, a roller support 7, a telescopic constant speed universal joint assembly 8, a spring mechanism 9 and a servo motor assembly 10. The mandrel 2 is mounted on an upper end surface of the spindle 1, and the driving synchromesh gear 3 is mounted on the spindle 1 and is located below the mandrel 2. Both the driven synchromesh gear 5 and the roller support 7 are L-shaped supports. The driven synchromesh gear support 5 includes a first vertical plate and a first bottom plate, the first vertical plate and the first bottom plate are integrally formed. The roller support 7 includes a second vertical plate and a second bottom plate, the second vertical plate and the second bottom plate are integrally formed, and the first bottom plate and the second bottom plate are arranged relatively in parallel. The vertical plate and the second vertical plate are arranged in parallel, and an inner side wall of the first vertical plate is contactable with an outer side wall of the second vertical plate. The driven synchromesh gear 4 is mounted on the first bottom plate through a bearing, the roller 6 is mounted on the second bottom plate through a bearing, and the driven synchromesh gear 4 and the roller 6 are arranged in parallel. The telescopic constant speed universal joint assembly 8 is mounted between the roller 6 and the driven synchromesh gear 4, thereby ensuring that the driven synchromesh gear 4 and the roller 6 rotate at the same angular speed and are capable of moving relatively in a radial direction. One end of the spring mechanism 9 is connected to an outer side wall of the first vertical plate, and the other end of the spring mechanism 9 is connected to the machine tool body. The spring mechanism 9 pushes the driven synchromesh gear support 5 to move towards the spindle. One end of the servo motor assembly 10 is connected to the outer side wall of the second vertical plate through a bearing assembly, and the other end of the servo motor assembly 10 is connected to the machine tool body. The servo motor assembly 10 drives the roller support 7 to move back and forth in the radial direction and drives the driven synchromesh gear support 5 to move away from the spindle 1.

This embodiment further provides the roll spinning forming method for the cup-shaped external gear piece using the aforementioned device. The method includes the following preparation steps.

1) Mounting the cup-shaped blank 11 used for preparation of the cup-shaped external gear piece on a mandrel 2, and the cup-shaped blank 11 is pressed on the mandrel 2.

2) Starting the spindle 1.

3) A servo motor assembly 10 is pushing the roller support 7 to drives the roller 6 to move towards the spindle 1, and at the same time, the spring mechanism 9 pushes the driven synchromesh gear support 5 and drives the driven synchromesh gear 4 to move towards the spindle 1.

4) When the driven synchromesh gear 4 and the driving synchromesh gear 3 are in contact with each other and gradually achieve complete engagement and synchronous rotation, the driven synchromesh gear 4 and the driven synchromesh gear support 5 stop moving, and the roller 6 is in contact with an outer surface of the cup-shaped blank 11, and may maintain the same angular speed as that of the driven synchromesh gear 4 under the driving the telescopic constant speed universal joint assembly 8.

5) The servo motor assembly 10 is continuously pushing the roller 6 to move towards the spindle 1. The roller 6 maintains a constant rotating speed ratio with the cup-shaped blank under the action of the driven synchromesh gear 4 and the driving synchromesh gear 3 which are completely engaged with each other. The roller 6 is gradually pressed into the cup-shaped blank 11 until a required tooth shape is formed on the outer surface of the cup-shaped blank 11, and the cup-shaped external gear piece is obtained. Or, the spindle 1 rotates forwards and reversely alternately according to a forming requirement to obtain a toothed profile with higher quality. During this period, the spring mechanism 9 provides a sufficient thrust to maintain the driven synchromesh gear 4 and the driving synchromesh gear 3 in a complete engagement state.

6) In a case that the driven synchromesh gear 4 and the driving synchromesh gear 3 are maintained to be completely engaged with each other, the servo motor assembly 10 drives the roller 6 and the roller support 7 to move away from the spindle 1 until the roller 6 is completely disengaged from the formed cup-shaped external gear piece.

7) The servo motor assembly 10 is continuously driving the roller support 7 to move away from the spindle 1 and drives the driven synchromesh gear support 5 to move away from the spindle 1 until the driven synchromesh gear 4 is completely disengaged from the driving synchromesh gear 3, and the driven synchromesh gear 4 is moved to a safe position.

8) Stopping the spindle 1. The formed cup-shaped external gear piece is ejected and removed by an ejector rod (omitted in the figure).

By the method according to this embodiment, the rotating speed ratio between the roller and the blank maintains constant in the roll spinning forming process, so that accurate tooth division can be realized, and the forming quality of the toothed part is ensured.

Embodiment 2

Figure 2:
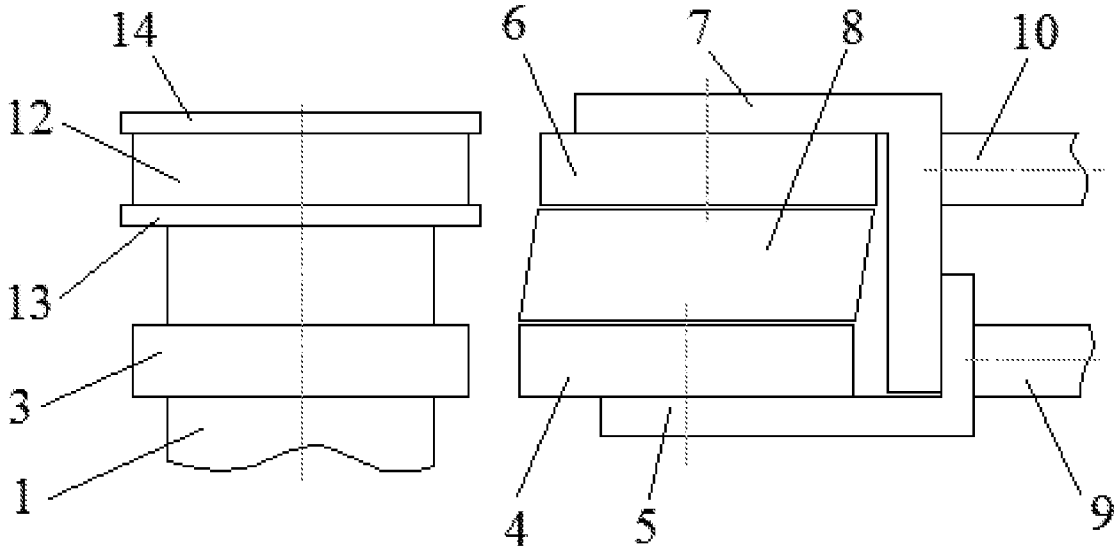
FIG. 2 is a structural schematic diagram of a roll spinning forming device for a solid external gear according to an embodiment 2.

This embodiment provides a roll spinning forming device for a solid external gear piece. As shown in FIG. 2, the device is mounted in a machine tool body and includes a spindle 1, a driving synchromesh gear 3, a driven synchromesh gear 4, a driven synchromesh gear support 5, a roller 6, a roller support 7, a telescopic constant speed universal joint assembly 8, a spring mechanism 9, a servo motor assembly 10, a flow limiting block 13 and a pressing block 14. The pressing block 14 presses a blank used for preparation of a toothed part on the flow limiting block 13. The flow limiting block 13 is arranged on the spindle 1. A diameter of the flow limiting block 13 is greater than an external diameter of the finally formed solid external gear piece. A diameter of the pressing block 14 is as same as a diameter of the flow limiting block 13, and the function is to limit a material of a solid disk-shaped blank 12 to flow upwards or downwards in the tooth profile forming process of the solid disk-shaped blank 12 to facilitate filling of the tooth profile and obtain a full tooth shape. The flow limiting block 13 is mounted on the upper end surface of the spindle 1, and the driving synchromesh gear 3 is mounted on the spindle 1 and located below the flow limiting block 13. Both the driven synchromesh gear support 5 and the roller support 7 are L-shaped supports. The driven synchromesh gear 5 includes a first vertical plate and a first bottom plate, and the first vertical plate and the first bottom plate are integrally formed. The roller support 7 includes a second vertical plate and a second bottom plate, and the second vertical plate and the second bottom plate are integrally formed. The first bottom plate and the second bottom plate are arranged relatively in parallel, the first vertical plate and the second vertical plate are arranged in parallel, and an inner side wall of the first vertical plate is contactable with an outer side wall of the second vertical plate. The driven synchromesh gear 4 is mounted on the first bottom plate through a bearing. The roller 6 is mounted on the second bottom plate through a bearing, and the driven synchromesh gear 4 and the roller 6 are arranged in parallel. The telescopic constant speed universal joint assembly 8 is mounted between the roller 6 and the driven synchromesh gear 4, thereby ensuring that the driven synchromesh gear 4 and the roller 6 rotate at the same angular speed and are capable of moving relatively in a radial direction. One end of the spring mechanism 9 is connected to an outer side wall of the first vertical plate, and the other end of the spring mechanism 9 is connected to the machine tool body, and the spring mechanism 9 pushes the driven synchromesh gear support 5 to move towards the spindle 1. One end of the servo motor assembly 10 is connected to an outer side wall of the second vertical plate through a bearing assembly, and the other end of the servo motor assembly 10 is connected to the machine tool body, and the servo motor assembly 10 drives the roller support 7 to move back and forth and drives the driven synchromesh gear support 5 to move away from the spindle 1.

This embodiment further provides the roll spinning forming method for the solid external gear piece using the aforementioned device. The steps of the method are as same as those of the rolling and spinning forming method for the cup-shaped external gear piece in the embodiment 1.

Embodiment 3

This embodiment provides the roll spinning forming device for internal and external tooth parts, which is as same as the roll spinning forming device for the cup-shaped external gear piece provided in the embodiment 1, except that outer side surfaces of the mandrel 2 and the roller 6 are provided with tooth shapes matched with the internal and external tooth parts.

Figure 3:
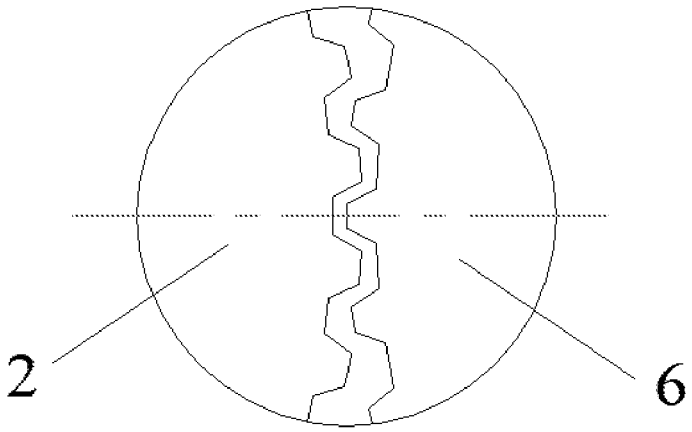
FIG. 3 is a schematic diagram of a phase position of a mandrel and a roller of a roll spinning forming device for internal and external tooth parts according to an embodiment 3.

This embodiment further provides the roll spinning forming method for internal and external tooth parts using the device. The steps included in the method are as same as those of the roll spinning forming method for the cup-shaped external gear piece in the embodiment 1, except that under the condition that the driven synchromesh gear 4 is completely engaged with the driving synchromesh gear 3, the roller 6 is mounted, thereby ensuring that the roller 6 is accurately aligned with a phase angle of the mandrel 2, as shown in FIG. 3.

Figure 4:
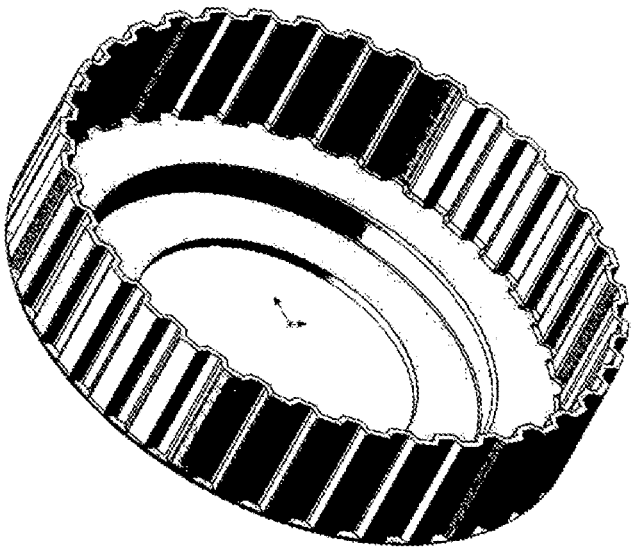
FIG. 4 is a schematic diagram of internal and external tooth parts formed in the embodiment 3.

FIG. 4 is a structural schematic gram of internal and external tooth parts formed by the method and device according to this embodiment.

As described above, the present invention may be implemented well. The above embodiments are only preferred embodiments of the present invention and are not used to limit the implementation scope of the present invention. That is, all equal changes and modifications made according to the content of the present invention are the protection scope of the claims of the present invention.

What is claimed is:

1. A roll spinning forming device for a toothed part, the roll spinning forming device being mounted on a machine tool body, and the roll spinning forming device comprising a spindle, a mandrel, a driving gear, a driven gear, a driven gear support, a roller, a roller support, a telescopic constant speed universal joint assembly, a spring and a servo motor assembly, wherein the mandrel is mounted on an upper end surface of the spindle, and the driving gear is mounted on the spindle and is located below the mandrel; the driven gear support comprises a first vertical plate and a first bottom plate, the first vertical plate and the first bottom plate are integrally formed, the roller support comprises a second vertical plate and a second bottom plate, the second vertical plate and the second bottom plate are integrally formed, the first bottom plate and the second bottom late are arranged relatively in parallel, the first vertical plate and the second vertical plate are arranged in parallel, an inner side wall of the first vertical plate is contactable with an outer side wall of the second vertical plate, the driven gear is mounted on the first bottom plate through a bearing, the roller is mounted on the second bottom plate through a second bearing, and the driven gear and the roller are arranged in parallel; the telescopic constant speed universal joint assembly is mounted between the driven gear and the roller, such that the driven gear and the roller rotate at a same angular speed and are capable of moving relatively in a radial direction;

one end of the spring is directly connected to an outer side wall of the first vertical plate and the other end of the spring is connected to the machine tool body, and the spring pushes the driven gear support to move towards the spindle; and one end of the servo motor assembly is connected to the outer side wall of the second vertical plate through a bearing assembly and the other end of the servo motor assembly is connected to the machine tool body, and the servo motor assembly drives the roller support to move back and forth in the radial direction and drives the driven gear support to move away from the spindle, and the driven gear is disengaged from the driving gear when the driven gear moves away from the spindle.

2. The roll spinning forming device for the toothed part according to claim 1, wherein a flow limiting block is arranged on the upper end surface of the spindle, and a diameter of the flow limiting block is greater than an outer diameter of the toothed part.

3. The roll spinning forming device for the toothed part according to claim 2, further comprising a pressing block pressing a blank used by the spinning formed toothed part on the flow limiting block.

4. The roll spinning forming device for the toothed part according to claim 3, wherein a diameter of the pressing block is as same as the diameter of the flow limiting block.

5. The roll spinning forming device for the toothed part according to claim 1, further comprising a pressing block pressing a blank used by the spinning formed toothed part on the mandrel.

6. The roll spinning forming device for the toothed part according to claim 1, wherein an outer side surface of the mandrel is provided with a tooth shape matched with the toothed part; and an outer side surface of the roller is provided with a tooth shape matched with the toothed part.

7. The roll spinning forming device for the toothed part according to claim 1, wherein both the driven gear support and the roller support are L-shaped supports.

8. A roll spinning forming method for the toothed part using the device according to claim 1, the method comprising the following steps:

step 1, mounting and pressing a blank used by a spinning formed toothed part;

step 2, starting the spindle;

step 3, using the servo motor assembly to push the roller support and drive the roller to move towards the spindle, and simultaneously using the spring to push the driven gear support and drive the driven gear to move towards the spindle;

step 4, when the driven gear and the driving gear are in contact with each other and gradually achieve complete engagement and synchronous rotation, enabling the driven gear and the driven gear support to stop moving, making the roller in contact with an outer surface of the blank, and maintaining an angular speed same as an angular speed of the driven gear under driving of the telescopic constant speed universal joint assembly;

step 5, continuously pushing the roller by the servo motor assembly to move towards the spindle, providing a thrust by the spring to enable the driven gear to be completely engaged with the driving gear, enabling the roller to maintain a constant speed ratio with the blank under an action of the driven gear and the driving gear which are completely engaged with each other, and pressing the roller into the blank until forming a required tooth shape on the outer surface of the blank;

step 6, in a case that the driven gear and the driving gear are maintained to be completely engaged with each other, driving the roller and the roller support by the servo motor assembly to move away from the spindle until the roller is completely disengaged from the formed toothed shape;

step 7, using the servo motor assembly to continuously drive the roller support to move away from the spindle, and drive the driven gear support to move away from the spindle until the driven gear is completely disengaged from the driving gear; and step 8, stopping the spindle and disassembling the formed toothed part.

9. The roll spinning forming method for the toothed part according to claim 8, wherein under a condition that the driven gear is completely engaged with the driving gear, the roller is mounted and is aligned with a phase angle of the mandrel.

10. The roll spinning forming method for the toothed part according to claim 8, wherein a rotation direction of the spindle in the step 5 is alternately forward and reverse.

* * * * *